US009027690B2

(12) United States Patent
Chavand

(10) Patent No.: US 9,027,690 B2
(45) Date of Patent: May 12, 2015

(54) WHEELED SHOES OR UNDERSOLES ENABLING FAST WALKING

(76) Inventor: Paul Chavand, Dijon (FR)

( * ) Notice: Subject to any disclaimer, the term of this patent is extended or adjusted under 35 U.S.C. 154(b) by 210 days.

(21) Appl. No.: 13/576,364

(22) PCT Filed: Jan. 31, 2011

(86) PCT No.: PCT/FR2011/050190

§ 371 (c)(1),
(2), (4) Date: Oct. 3, 2012

(87) PCT Pub. No.: WO2011/092443

PCT Pub. Date: Aug. 4, 2011

(65) Prior Publication Data

US 2013/0025955 A1 Jan. 31, 2013

(30) Foreign Application Priority Data

Feb. 1, 2010 (FR) ..... 10 00409

(51) Int. Cl.

| | |
|---|---|
| ***A63C 5/08*** | (2006.01) |
| ***A63C 1/00*** | (2006.01) |
| ***A63C 17/12*** | (2006.01) |
| *A63C 17/06* | (2006.01) |
| *A63C 17/10* | (2006.01) |

(52) U.S. Cl.

CPC ..... *A63C 17/12* (2013.01); *A63C 17/06* (2013.01); *A63C 17/10* (2013.01)

(58) Field of Classification Search

CPC ..... A63C 17/06; A63C 1/00; A63C 17/061; A63C 17/065; A63C 17/10; A63C 17/12

USPC ..... 280/844, 841, 11.19, 11.115, 221, 210, 280/220; 180/181, 180, 190, 184

See application file for complete search history.

(56) References Cited

U.S. PATENT DOCUMENTS

| | | | | | |
|---|---|---|---|---|---|
| 602,704 | A | * | 4/1898 | Kinsbruner | 280/11.115 |
| 619,370 | A | * | 2/1899 | Wagner | 280/11.115 |
| 999,660 | A | * | 8/1911 | Koppel | 280/11.115 |
| 1,208,173 | A | * | 12/1916 | Lenhardt | 280/11.115 |
| 1,437,314 | A | * | 11/1922 | Jorgensen | 280/11.115 |
| 1,672,700 | A | * | 6/1928 | Gabor Vass | 280/11.31 |
| 1,784,761 | A | * | 12/1930 | Smith | 280/11.115 |
| 3,876,032 | A | * | 4/1975 | Ferino | 180/181 |

(Continued)

FOREIGN PATENT DOCUMENTS

| | | |
|---|---|---|
| FR | 2 896 998 A1 | 8/2007 |
| WO | WO 01/87436 A1 | 11/2001 |

*Primary Examiner* — J. Allen Shriver, II
*Assistant Examiner* — James M Dolak
(74) *Attorney, Agent, or Firm* — Arent Fox LLP

(57) ABSTRACT

Personal transport means for walking at faster speeds than normal walking, made up of a pair of wheeled shoes or wheeled undersoles (1-1) that can be adapted by quick attachment (1-2) to the soles of the normal shoes of a walker, laterally articulated (1-3) to follow the natural movements of the heels relative to the tips of the feet (1-10) during normal walking, and allowing walking at higher speeds, without any skating movements, without having to gain momentum, and without modifying the rhythm, amplitude or longitudinal stability of natural walking, by means of a servomotor (1-4) which allows the speed of the driving wheels to exceed the skidding force (1-5*a*, 1-5*b*) resulting from the force transmitted by the supporting leg (1-6), and comprising an accelerator (1-8) and a brake (1-9) controlled by the foot of the walker.

17 Claims, 3 Drawing Sheets

(56) References Cited

U.S. PATENT DOCUMENTS

Figure 1:
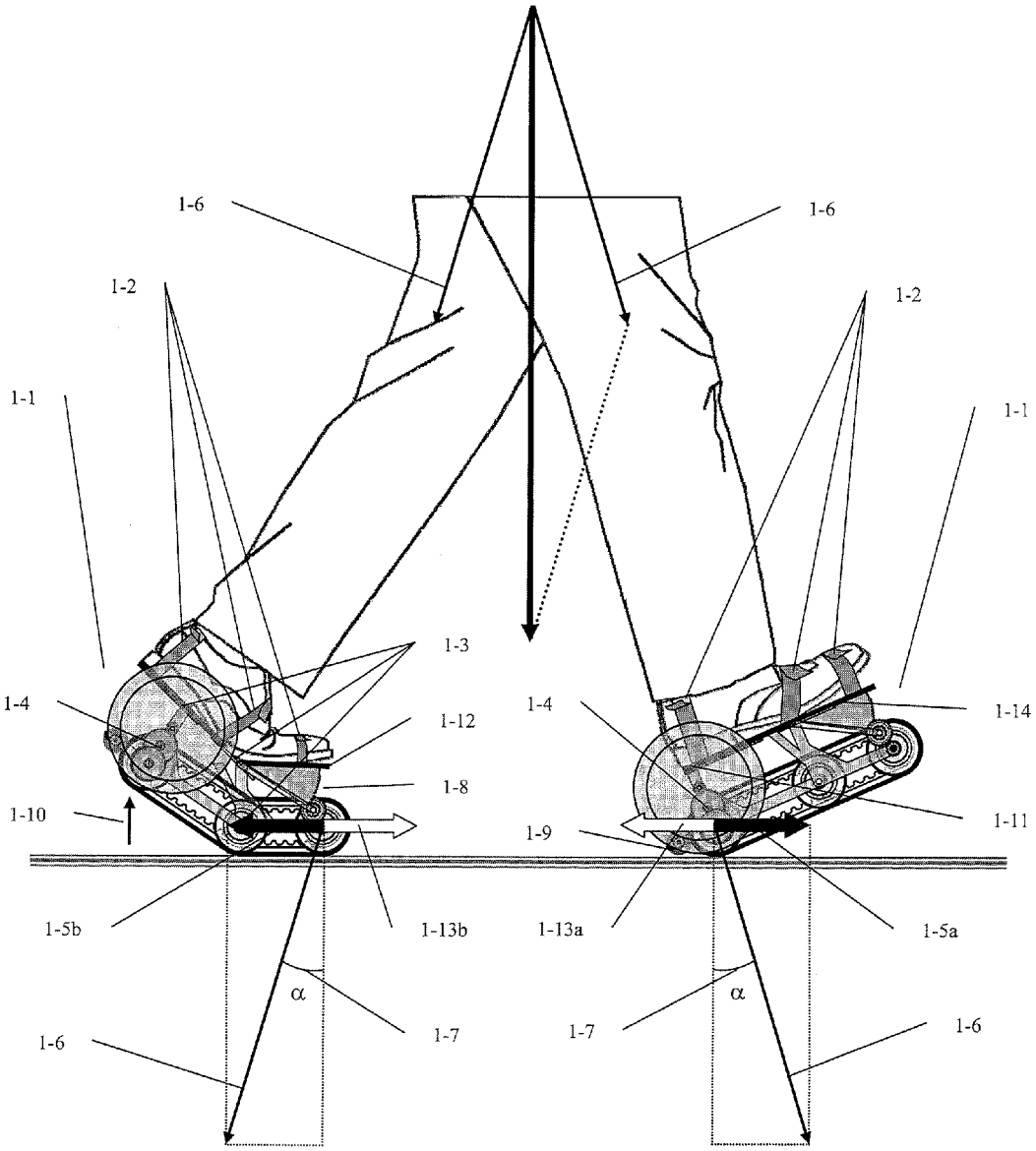

| | | | | | |
|---|---|---|---|---|---|
| 4,508,187 | A | * | 4/1985 | Wenzel | 180/181 |
| 4,602,801 | A | * | 7/1986 | Vincent | 280/11.115 |
| 4,696,485 | A | * | 9/1987 | Lee | 280/221 |
| 4,915,403 | A | * | 4/1990 | Wild et al. | 280/221 |
| 5,056,802 | A | * | 10/1991 | Piotrowski | 280/11.115 |
| 5,382,052 | A | * | 1/1995 | Tarng | 280/844 |
| 5,492,345 | A | * | 2/1996 | Kruczek | 280/11.115 |
| 5,730,241 | A | * | 3/1998 | Shyr et al. | 180/181 |
| 5,826,674 | A | * | 10/1998 | Taylor | 180/219 |
| 6,237,923 | B1 | * | 5/2001 | Fowle | 280/11.115 |
| 6,626,442 | B2 | * | 9/2003 | Pahis | 280/11.115 |
| 7,073,805 | B2 | * | 7/2006 | Yan | 280/221 |
| 7,204,330 | B1 | * | 4/2007 | Lauren et al. | 180/181 |
| 7,383,908 | B2 | * | 6/2008 | Tuli | 180/181 |
| 7,568,706 | B2 | * | 8/2009 | Ng et al. | 280/11.115 |
| 7,744,100 | B2 | * | 6/2010 | Cole | 280/11.115 |
| 7,866,672 | B2 | * | 1/2011 | Brunner | 280/11.115 |
| 8,376,378 | B2 | * | 2/2013 | Keel | 280/87.042 |
| 8,668,039 | B2 | * | 3/2014 | Tuli | 180/181 |
| 2008/0061521 | A1 | | 3/2008 | Ng et al. | |

* cited by examiner

WHEELED SHOES OR UNDERSOLES ENABLING FAST WALKING

CROSS-REFERENCE TO RELATED APPLICATION

This Application is a National Stage entry of International Application No. PCT/FR2011/050190, having an international filing date of Jan. 31, 2011; which claims priority to French Application No.: 1000409, filed Feb. 1, 2010; the disclosure of each of which is hereby incorporated in its entirety by reference.

The present invention pertains to the urban mobility field, and relates to a personal transport means for walking at faster speeds than normal walking, without any skating movement, without having to gain momentum, and without modifying the rhythm, amplitude or longitudinal stability of natural walking.

The invention constitutes a new personal transport means, mostly for urban environments, achieving an advantageous combination of walking and moving walkway, which could be defined as a type of "gradual and embedded pedestrian conveyor" which unrolls under the shoes of a walker. Thus, the invention has more advantages than all the currently available personal transport means, whereof particularly rapidity, safety, ergonomy, the very low personal bulk and the immediate mastery without learning.

The invention consists of a pair of wheeled shoes, or advantageously, wheeled undersoles 1-1 adaptable by quick attachment 1-2 to the soles of normal shoes of a walker, and enabling to walk at a speed twice or three times faster (additional speed reaching around 8 km/h) without learning and in complete security.

These wheeled shoes or undersoles 1-1 comprise an upper plate 1-11, 1-14 (actual undersoles) mounted on a chassis resting on at least a set of wheels 2-4 or tracks 2-5 in contact with the ground. They comprise a lateral articulation 1-3 enabling natural movements of the heels with respect to the tips of the feet 1-10 during normal walking, thus, giving more comfort than rollerblades, for example. This lateral articulation of the back portion 2-2 (slightly more than half the undersole) with respect to the front portion 2-3 is obtained thanks to an axis or a hinge system 1-3, the back portion thus, being able to swivel in the vertical plan to follow the detachment and the lifting of the heel of the supporting foot with respect to its tip 1-10, which occur naturally in the middle and at the end of a step during normal walking.

Each of these two portions may singly bear the weight of the body while rolling on wheels 2-4 or tracks 2-5, such that, whatever the initial speed of the wheeled shoe or undersole with respect to the ground, the body weight successively rests, according to the step phases of the supporting foot, on the rear end of the back portion when the heel 1-11 is laid down on the ground, then on the entirety of the two portions, then on the single front portion 1-12 during the last step phase.

It has been known document WO 01/87436 A1 which discloses a laterally articulated wheeled shoe, but according to a different function to that described above. In fact, the lateral articulation of this wheeled shoe is intended to enable a type of pendulum movement of the feet " . . . of the walker, who, by alternatively exerting the pressure of his/her body weight on the sole from back to front and from one foot to the other" (page 3, lines 27 to 29) provides forward motricity; this movement is described in two stages: "first, by descending, under the pressure of the user body weight being exerted on the heel, the buffer spring 5 of the rear gets compressed and that of the front gets decompressed" (page 8 lines 25 to 27), then, "subsequently, by descending, under the pressure of the users body weight being exerted on the tip of the foot, the buffer spring 5 of the front gets compressed and that of the back gets decompressed" (page 9 lines 1 to 3), showing that his/her weight is bearing on the entire sole, whereof the purpose of the global rotation around the articulation is to activate the "motor mechanisms", but without substantially modifying the orientation of the heel with respect to the tip of the foot. Nowhere does this document disclose the possibility of the elevation of the heel of the supporting foot with respect to its tip, particularly having for effect to significantly close the angle formed by the heel and the tip of the foot (cf. FIG. 2 of the present document).

A set of wheels on each side of the shoe or undersole gives it lateral stability. With furthermore complete longitudinal stability enabling to keep the amplitude of natural walking, and constituting the technical basis of the invention (see below), the invention maintains the walker in natural walking balance without needing to make any particular effort, nor any need for maintaining the ankles, whatever the step phase and initial speed, with respect to the ground, of the wheeled shoes or undersoles.

The operating principle of the invention is based on the compensation of the natural forward or backward skidding force, i.e., the component parallel to the ground, forwards during the strike of the heel 1-5*a*, and backwards during the final phase of the step 1-5*b*, of the force transmitted to each wheeled shoe or undersole by the supporting leg, compensation not able to be braking, which would prevent the wheels from taking up the speed necessary for a higher walking speed than that of normal walking.

In fact, during natural walking, the force of the weight of the walker, applied in his/her center of gravity, may be decomposed in two forces: a component parallel to the ground and a component in the direction of the supporting leg 1-6, which intensity is P.g. cos $\alpha$p/cos $\alpha$ (where P designates the weight of the walker, $\alpha$ the angle between the line perpendicular to the ground and the supporting leg 1-7, $\alpha$p the ground slope angle 2-11 with respect to the horizontal, and g the acceleration of gravity). This component transmitted by the supporting leg may, itself, be decomposed, at its application point at the wheeled shoe or undersole, into a component perpendicular to the ground, cancelled by the reaction of the ground, and a component parallel to the ground 1-5*a* and 1-5*b*, of which algebraic intensity is P.g. cos $\alpha$p.tg $\alpha$ (with the same notations). This component which is parallel to the ground is a relatively important skidding force: for example, for a walker having a maximum step angle $\alpha$ equal to 14°, the maximum intensity of this force, forward just like backward, is of the order of the quarter of his/her weight.

Although every walker very rarely experiences skidding, when the ground becomes slippery (dead wet leaves, snow, ice, etc.), conditions in which he/she instinctively reduces his/her footstep amplitude, hence the value of angle $\alpha$ and the skidding force which nearly linearly depends on it, he/she forgets it nearly all the time, due to the frictional force of his/her shoe sole on the ground, which compensates it perfectly. It is only when a lack of adherence of the sole to the ground takes the walker by surprise, that this skidding force unbalances him/her and may make him/her fall, by what is known as the "splits".

Likewise, by getting onto a device which may roll freely, the frictional force no longer exists (by overlooking the mechanical friction), and one becomes a "skater", who must permanently manage his/her balance, by especially avoiding natural walking movements.

Such as the invention is described object of aforementioned document WO 01/87436 A1, no full analysis has been carried out pertaining to the effect of the skidding force on a rolling system enabling walking, and skidding compensation force notions, maintaining amplitude and longitudinal stability of normal walking are in no way disclosed. Particularly, the forward skidding force subjected by the foot during the first phase of the step (putting down the heel) is not compensated by a backward force, all the "motor mechanisms" described and illustrated having for effect to "transmit" or "reinforce" or "multiply" the forward motricity of the driving wheels by means of each "drivetrain", and no backward motricity other than braking being mentioned; thus the motricity which is hence exerted in the forward direction further amplifies the skidding to splits, thus confirmed by the description of the step: "One step with the apparatus, i.e., a mere rear pressure followed by front pressure is enough to cover several meters." (page 9 lines 10 and 11).

The present invention achieves the compensation of the forward or backward skidding force, by artificially creating an opposite force 1-13*a* and 1-13*b*, thanks to a motor system coupled to driving wheels 1-4, and controlled by a system for controlling the speed of the driving wheels, which frees this speed from the skidding force effect which tends to increase it (forward skidding) or to reduce it (backward skidding) by adjusting at any instant the engine torque, in one direction or the other, to the compensation value, whatever the value of the angle $\alpha$ 1-7 of the supporting leg perpendicularly to the ground, and whatever the initial speed with respect to the ground of the wheeled shoe or undersole. In order to obtain the best compensation on the wheeled shoe or undersole assembly, at least a belt, advantageously notched 2-16, or any other equivalent mechanical means (chain, gears, transmission shaft) make it possible to securely couple the assembly of these axles and wheels.

Several types of motors, corresponding to several energy sources, are operatable for producing this compensation force: inertia motor, constituted of at least a flywheel coupled to the driving wheels via a high reduction ratio, and using the kinetic energy stored by the flywheel, electric motor, using the energy of a rechargeable electric battery, gravitational potential energy motor, using, using, as energy storage, the height with respect to the ground of the walker himself/herself, mechanical motor with elastic energy, stored in a mechanical, pneumatic or hydropneumatic spring, or even any motor system obtained by combining, all or part, of these types of energy. In all cases, and with the preceding notations, the algebraic intensity of the compensation force created by the motor system must be as close as possible to the value—P.g. cos $\alpha$p.tg $\alpha$, the type of each feedback control system depending on the type of controlled motor. In all the following, the term cos $\alpha$p will not be used, the ground slope being supposedly very low.

The motor used may advantageously be reversible, i.e., being able to operate either in motor mode, by supplying an engine torque by energy consumption or in generator mode, by producing energy when it is provided with an engine torque. In fact, as soon as the wheeled undersole has acquired speed with respect to the ground, the skidding force works during its forward movement during the heel phase (from the strike of the heel to the lifting of the supporting leg perpendicularly to the ground), this work (in the force direction, hence positive) producing an energy W, and during the tip phase (from the loss of orthogonality of the supporting leg with the ground until the last push on the tip of the foot), this work (in the direction opposite to the force, hence negative) consuming energy W (the symmetry of the angles between the two phases is acknowledged). Reversibility of the motor thus enables to recover the energy produced during the heel phase, to consume it during the tip phase, which, at constant speed of the wheeled shoe or undersole, thus, hardly consumes any outer energy (depending on the output of the motor in each of its two operating modes).

The motor system may be completed by a ratchet wheel system 2-8 which makes it possible to avoid any backward motion when the wheeled shoes or undersoles are at a standstill.

Furthermore, the symmetry, during each step, of the backward skidding force on a leg and of the forward skidding force on the other, ensures that the wheeled shoes or undersoles thus, cannot acquire speed. Hence, they need a complementary "accelerator" device, creating an overcompensation in the forward direction to enable the gradual increase, in a few steps, of the walkers global speed. By a lesser action on this accelerator, the walker may also compensate the frictional forces of all the mechanisms, and thus maintain his/her speed. This accelerator is constituted of an acceleration drive system coupled to driving wheels, with electric or gravitational potential energy, enabling to supply an additional engine torque to the driving wheels in the walking direction, and a "foot tip control", located at the front portion of the upper plate, which makes it possible to increase this engine torque proportionally to the pressure that it is subjected to from the tip of the supporting foot. In order to roll freely without acceleration when the walker wishes to "let himself/herself roll" without walking on his wheeled shoes or undersoles, this foot tip control is only active when the back portion of the upper plate is raised with respect to the front portion (end of step phase).

Finally, a gradual and efficient braking system 2-15 enables a stop in one or several steps, according to the wish of the walker, thanks to a specific action of the foot on the wheeled shoe or undersole, such as for example maintaining the heel on the ground while lifting the tip of the foot beyond what is necessary for normal walking 1-9.

A first particular embodiment of the invention uses an inertia motor, composed of at least a flywheel coupled to the driving wheels via a high reduction ratio, the energy of the motor thus being the kinetic energy stored in each flywheel in rapid rotation 2-6. The dual advantage of this type of motor is that its is nearly perfectly reversible during the very low duration of each step, and that the independence of its speed, hence of that of the driving wheels, with respect to the skidding force, integrally results from its property, intrinsic in inertia, to resist to any forced change to its speed by an inertial counter torque; the control of the speed is hence by nature integrated to the motor. Intuitively, the same thing occurs, at a higher energy level, as in a miniature car with friction motor: just as the car resists the forced advancement ("friction") which enables to launch the motor, the inertia motor, subject to a sufficient reduction ratio 1-4 highly resists the forward skidding force during the heel phase, while storing the energy produced by this force; conversely, a symmetrical effort is needed to stop the friction car, the inertia motor from the backward skidding force during the tip phase, by restoring the energy it has just stored in heel phase. The ideal compromise to be found would consist in minimizing to the maximum the weight of the wheel (hence that of the wheeled shoe or undersole) by increasing the reduction ratio, within the limit however of the maximum admissible angular speed (limited by the vibrations or the risk of bursting of the wheel).

Due to the gyroscopic effect (strong directional inertia in the plan of the flywheel), it may be advantageous to divide the flywheel into two driving wheels turning in opposite directions (called "counter-rotating" arrangement), such as to cancel the gyroscopic effect and enable an entirely free lateral orientation of each foot, as in normal walking.

In this first particular embodiment of the invention, the foot tip control of the accelerator is the front portion of the upper plate 2-3, also laterally articulated, for constituting a pedal mechanically coupled to driving wheels by racks 2-7, cables, chains, belts, or gears 2-12, which increases the speed of driving wheels thanks to the gravitational potential energy brought by the pressure of the walkers body weight on his/her foot tip and its sinking by several millimeters or centimeters, according to the initial speed acquired beforehand by the wheeled shoe or undersole. As long as the back portion of the upper plate does not rise, an extension reinforcement under the front portion (cf. FIG. 2) blocks this pedal in high position, its mechanical coupling with the driving wheels thus being declutched; at the end of the lowering of the pedal, just as for its rising, this coupling is also declutched, thus enabling in the three cases a free rolling starting from the acquired speed. This declutching of mechanical coupling between the pedal and the driving wheels when the rear portion of the upper plate is not raised, or when the pedal is at the end of its lowering or in rising movement, is obtained thanks to an articulated arm on the same axis as the pedal, but independently from it, supporting an intermediary engagement 2-12 still engaged with the rack of the pedal, and provided with a spring raising it up in disengaged position, in order to achieve a temporary coupling "engaging with the effort in the right direction".

A second particular embodiment of the invention uses an electric motor coupled to driving wheels by a reduction ratio adapted to the nominal regime of the motor. In this case, the electric energy is stored in an electric rechargeable battery, and the adjusting of the engine torque at a value leading to the compensation of the skidding force is obtained by a system for electronically controlling the rotation speed of the driving wheels at the required speed order, the rotational speed being measured thanks to a specific sensor; it is dually advantageous to use a reversible electrical motor, for example a DC electric motor that behaves like a dynamo when the motricity of its rotor is produced by an outer means, even partially (taking the imperfect outputs of this type of motor-generator into account), as its operating in generator mode, during the front skidding, on the one hand, naturally contributes to the stability of the speed, the generator resisting all the more as it produces more energy, and on the other hand partially recovers the produced energy, thus significantly reducing the consumption of the motor during each step. Moreover, this reversibility may enable, by extension, the use of wheeled shoes or undersoles on slopes, the battery restoring uphill the electric energy that the motor-generator has produced by limiting the speed downhill.

In this second particular embodiment of the invention, the foot tip control of accelerator is a pressure transducer of the tip of the foot on the front portion of the upper plate, which, as soon as the back portion of the upper plate is raised with respect to this front portion, it directly acts on the speed order of the electronic control system in order to increase the required speed proportionally to the measurement of obtained pressure.

A third particular embodiment of the invention uses a mechanical motor operating the gravitational potential energy of the actual walker, thanks to a variable attitude mechanism of the upper plate of the undersole, rendered mobile vertically with respect to the chassis, and mechanically coupled to the driving wheels in a reversible manner by racks, cables, chains, belts or gears. This type of mechanical motor is perfectly reversible, the gravitational potential energy provided by the lowering of the upper plate, hence of the walker himself/herself, which thus constitutes the energy storing device, producing the engine torque, and, conversely, any outer forward motricity supplied to the driving wheels producing the rising of the walker, hence, the corresponding gravitational potential energy. Moreover, the torque supplied by the motor is proportional to the weight of the walker whatever his/her speed, thus only leaving angle $\alpha$ 1-7 as a an adjustable variable of the compensation force to be obtained.

The control of the speed of the driving wheels is obtained in this case by adjusting the torque engine to the compensation value of the skidding force at the coupling at the driving wheels, by at least a rotating torque variator, whereof the torque variation is controlled by the variable characteristic of the skidding force, namely the angle $\alpha$, measured by means of a sensor that is specific to each of the heel or tip phases of the step.

For the heel phase of the step, a mechanical means for achieving the sensor of the angle $\alpha$ 1-7 consists in mounting the axis of the back wheels onto a compression spring enabling it a slight vertical movement with respect to the chassis, and to arrange an articulated arm at an end on this axis 3-17, and provided with a caster at its free end 3-18, with, very close to its articulation, a lever point by a second articulation secured to the chassis; the caster of this articulated arm is maintained raised by the upward lever effect due to the downward pressure of the spring on the axis of the back wheels when these are not in contact with the ground, and pressed to the ground by the downward lever effect as soon as the axis of the back wheels touches the ground by upwardly compressing its spring under the effect of the weight of the walker; the measurement of the angle $\alpha$ during the heel phase of the step is thus obtained by means of a mechanical sensor of the inclination of the upper plate with respect to the articulated arm in contact with the ground, inclination equal to the angle $\alpha$ with a roughly constant deviation. For the tip phase of the step, a means for achieving the mechanical sensor of the angle $\alpha$ consists in directly measuring the angle formed by the back portion 2-2 and the front portion 2-3 of the upper plate, whereof the value is very close to a due to the quasi orthogonality between the rear portion and the supporting leg, the front portion being parallel to the ground at this instant.

One of the means of achieving the rotating torque variator consist in adapting to the invention constraints, the classic mechanical system of the dual inverted cones with belt, by particularly avoiding the sliding belt which does not enable the torque variation when the motor is at a standstill, in order to make it a system with "dual inverted and superposed curvilinear cones" 3-10, whereof the axes 3-11 remain maintained in the same vertical plan. The torque variation according to the angle $\alpha$ 1-7 is constituted by coupling the sensor of the angle $\alpha$ to the inclination control of the axis of the upper curvilinear cone in this vertical plan 3-19, 3-16, which makes this curvilinear cone roll on the lower curvilinear cone along their respectively lower and higher 3-12 generatrice, the two cones also being able to turn around their respective axis for the torque transmission 3-13, which is thus function of the ratio of the radius of the section disks at their contact point. Thus, the sliding belt is eliminated as it could not have slid at a standstill, and one may freely determine, for each inclination angle of the axis of the upper cone, hence for each angle $\alpha$ measured mechanically as described above, the required ratio of the radiuses, thus determining the curvilinear profile 3-20 of the cones.

In this type of rotating torque variator with dual inverted and superposed curvilinear cones, the low surface of the contact area of the two cones requires to minimize sliding. The friction required for the torque transmission on the contact area of the curvilinear cones may be obtained at the same time by the choice of a material that is sufficiently rough or adhesive, and by applying a sufficient pressure force on the axis of the upper curvilinear cone 3-21, this force being able to use, in all or part, the component perpendicular to the ground of the force applied to the upper plate by the supporting leg 3-19, or the pressure springs on the bearings of the axis of the upper curvilinear cone 3-22.

In this third particular embodiment of the invention, the compensation of the skidding force should only be carried out temporarily, i.e., only during the heel or tip of the step phases, during which the skidding force is non null; during the intermediary phase of the step, during which no skidding force is exerted, the bearing of the control of the torque variator corresponding to the null value of the active angle $\alpha$ hence a release mechanism of the torque to the driving wheels, in order to enable them to turn freely; this release mechanism at the same time blocks the variable attitude system, hence the system for storing the gravitational potential energy, in order to keep the stored energy in heel phase to be able to restore it to the tip phase, the release thus stopping with the unblocking of the energy storage device.

Finally the accelerator of this third embodiment of the invention is at all points identical to that of the first embodiment (kinetic version).

A fourth particular embodiment of the invention uses a mechanical motor operating the energy of an elastic energy storage device, comprising at least a linear 3-5 or rotating spring, whether it be mechanical 3-5, pneumatic or hydropneumatic, and mechanically coupled to the driving wheels in a reversible manner by racks, cables 3-8, chains, belts or gears. The compensation force needing to always be proportional to the weight of the walker; this spring is of "constant force" type; such springs exist on the market, generally in the form of spiral springs for rewind reels, these springs being provided to be twinned in diverse ways according to the required force and extension; the constant force may also be obtained based on a classic linear spring of constant stiffness, with elongation or compression, mechanical 3-6, pneumatic or hydropneumatic, coupled to a traction cable 3-1 winding around a cam 3-7 whereof the angular variation of the radius is calculated to compensate, via the resulting torque, the variation of the force of the linear spring according to its elongation or compression.

The constant force of the elastic system must be pre-regulated according to the weight of the walker; a device for preconstraining the spring may be used, as for example a adjustment screw 3-9, as well as an ab initio choice of spring according to the weight of the user, these two means able to be complementary (after the choice of the spring, possibility of adaptation of its force, for example according to the clothing and the momentary charge of the walker). This type of motor is also perfectly reversible, the elastic energy producing, in motor mode, a constant engine torque, and conversely, an outer engine torque producing, in generator mode, the elastic energy. The system for controlling the speed of the driving wheels of this fourth particular embodiment of the invention may be achieved with at least a torque variator in all points identical to that of the third particular aforementioned embodiment. Likewise for the release mechanism of the coupling to the driving wheels with blockage of the energy storage system, i.e., in this case, the elastic system, during the intermediary phase of the step, during which no skidding force is exerted.

Here again, the accelerator of this fourth embodiment of the invention is in all points identical to that of the first embodiment (kinetic version).

The following figures describe all the main mechanisms of the invention.

FIG. 1 describes the main principle, illustrated in the first particular embodiment of the invention (kinetic energy).

Figure 2:
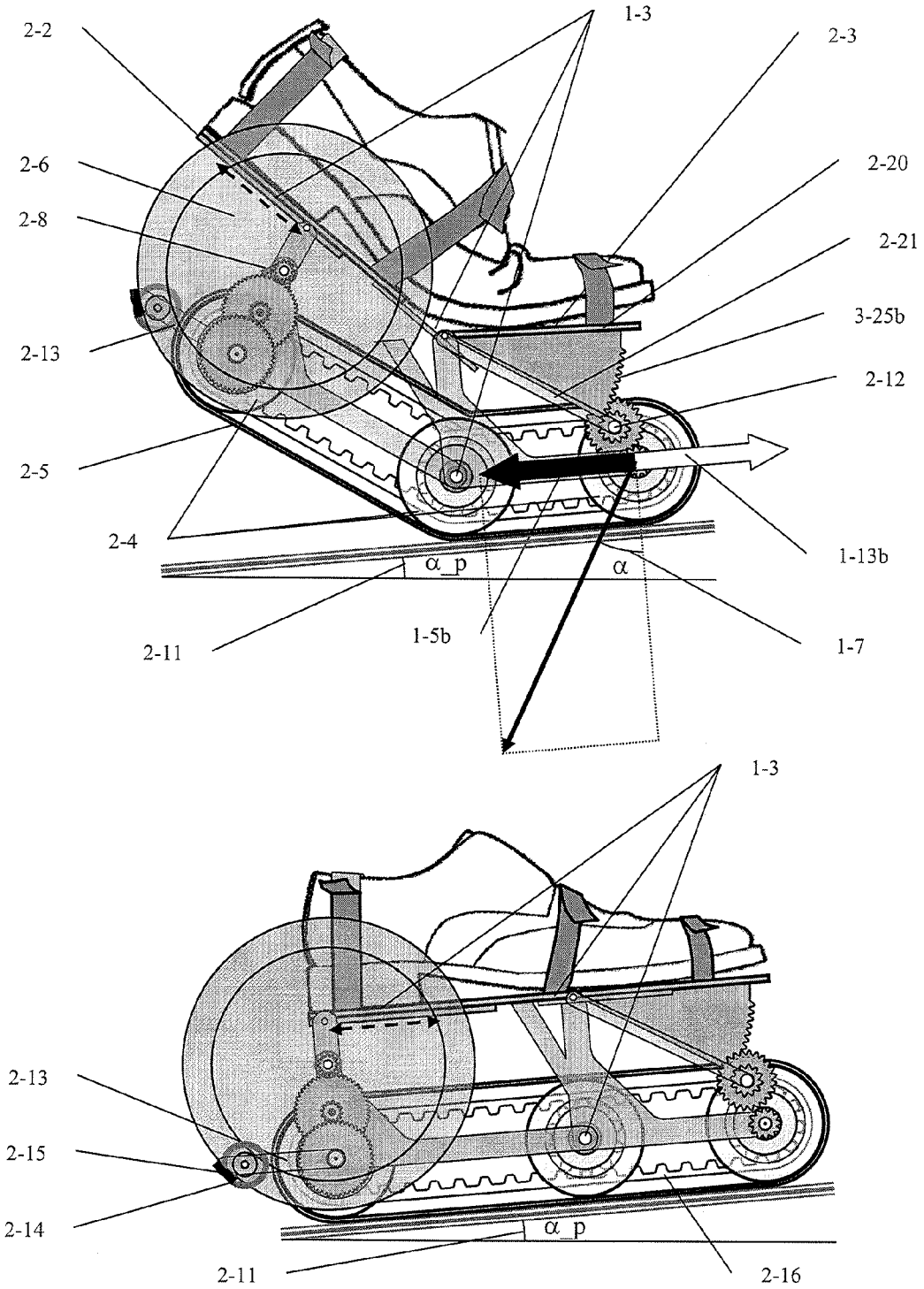

FIG. 2 details, still in this first particular embodiment, the operating of the articulation hinge between the front portion and the back portion of the wheeled undersole, as well as the detail of the accelerator.

Figure 3:
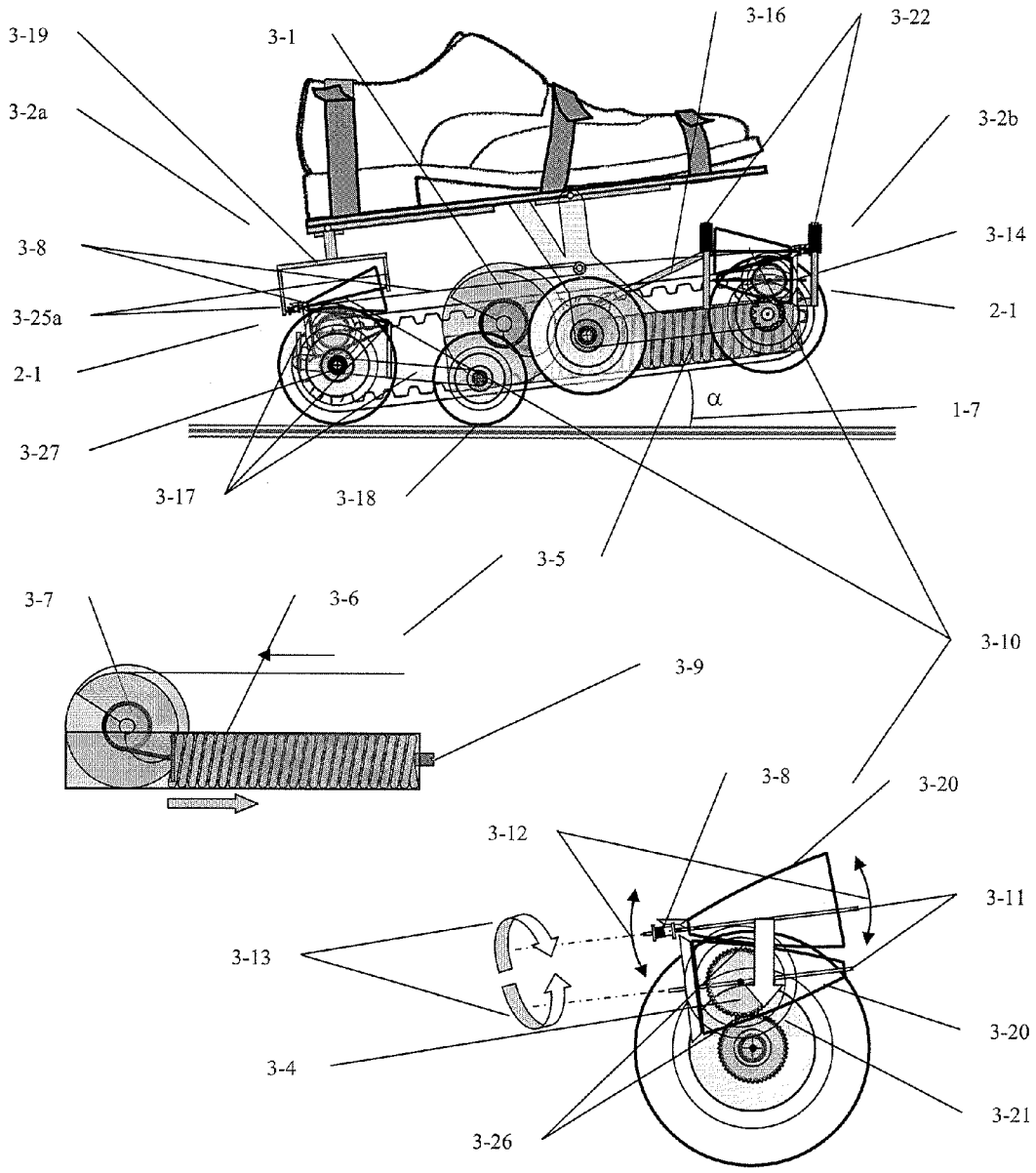

FIG. 3 shows the main mechanisms of the more complex version (elastic energy).

This invention opens up a large industrial field of mass manufacture of the different versions of these wheeled shoes or undersoles, their market being the general public at least in big and medium-sized cities of the world, and a complementary market being based on sports versions.

The invention claimed is:

1. A personal transportation device for walking at faster speeds than normal walking, made up of a pair of wheeled shoes or wheeled undersoles comprising:

quick attachment means adapted for attaching said wheeled shoes or wheeled undersoles to the soles of the normal shoes of a walker;

driving supporting means in contact with the ground;

a back portion and a front portion for supporting the soles of the normal shoes of the walker, each of said back portion and said front portion being composed of a distinct upper plate mounted on a chassis resting on at least one set of said driving supporting means said back portion and front portion being laterally articulated together to follow, during normal walking of a supporting foot having a tip and a heel, the movement of the heel, being off the ground, respectively supported on the ground, with respect to the tip, being supported on the ground, respectively off the ground;

a motor system coupled to the driving supporting means; and a control system adjusting at any time an engine torque, in one direction or the other, to a compensation value allowing the speed of the driving supporting means to free the effect of the skidding force constituted by the component parallel to the ground of the force applied to each wheeled shoe or undersole by the supporting leg, wherein said compensation value is based on:

the value of the angle of the supporting leg perpendicular to the ground, and an initial speed with respect to the ground of the wheeled shoes or undersoles, wherein the wheeled shoes or undersoles are configured to enable walking at faster speeds, by the mere movements of normal walking, keeping the rhythm, amplitude, and longitudinal stability, without any skating movement.

2. The personal transportation device according to claim 1, wherein each of the two wheeled shoes or undersoles comprises a lateral articulation, around an axis or a hinge system which enables the back portion to swivel in a vertical plane with respect to the front portion, to follow a detachment and a lifting of the heel of the supporting foot with respect to the tip of the supporting foot, which occur naturally in the middle and at the end of a step during normal walking; each of these two portions being adapted to support alone the body weight while rolling on said driving supporting means.

3. The personal transportation device according to claim 1, wherein each wheeled shoe or undersole comprises accelerator means for creating an overcompensation in the forward direction to enable the gradual increase, in a few steps, of the walkers global speed, said accelerator means comprising:

an acceleration drive system coupled to the driving supporting means;

means for supplying the acceleration drive system with energy to provide an additional engine torque to the driving supporting means in the walking direction; and a foot tip control located at the front portion of the upper plate, which, when the back portion is raised with respect to this front portion, enables to increase this engine torque proportionally to the pressure that foot tip control is subjected to by the tip of the supporting foot.

4. The personal transportation device according to claim 1, wherein, for each of the two wheeled shoes or undersoles, said personal transportation device comprises:

an elastic energy storage device;

said motor system comprising at least a mechanical motor operating the energy of the elastic energy storage device, comprising at least a constant-force spring, whether it be linear or rotating, mechanical, pneumatic or hydropneumatic, the constant force being adjustable at the start by an initial pre-adjustment according to the weight of the walker; this spring being mechanically coupled to the driving wheels by racks, cables, chains, belts or gears, and via at least a rotating torque variator; the control of the speed of the driving wheels being achieved by the rotating torque variator, whereof the variation is controlled by the variable characteristic of the skidding force, namely the angle $\alpha$, measured by means of a sensor specific to each of the heel and tip phases of the step.

5. The personal transportation device according to claim 4, wherein the constant-force spring may be obtained based on a classic linear spring of constant stiffness, by coupling to a traction cable winding around a cam whereof the angular variation of the radius is calculated in order to compensate, via the resulting torque, the variation of the force of the linear spring according to its elongation or its compression.

6. The personal transportation device according to any of claims 1, 2, or 3, wherein said driving supporting means comprising wheels and/or track in contact with the ground.

7. The personal transportation device according to claim 3, wherein said means for supplying the acceleration drive system are supplied with electric energy, or gravitational potential energy.

8. The personal transportation device according to claim 1; wherein the motor system comprises at least one of a kinetic motor, an electric motor, a motor supplied with gravitational potential energy, a motor supplied with elastic energy or even of several motors combining wholly or partially these types of energy.

9. The personal transportation device according to claim 5, wherein the linear spring is mechanical, pneumatic or hydropneumatic.

10. The personal transportation device according to claim 8, wherein, for each of the two wheeled shoes or undersoles, said personal transportation device comprises:

a specific sensor;

said motor system comprising at least an electric motor coupled to driving supporting means, using energy stored in at least one electric rechargeable battery;

an electronic system for controlling the rotational speed of the driving wheels at the required speed and allowing adjusting the engine torque to the value contributing or leading to compensation of the skidding force, the rotational speed being measured by means of a specific sensor;

a foot tip control located at the front portion of the upper plate, which, when the back portion is raised with respect to this front portion, enable to increase this engine torque proportionally to the pressure that foot tip control is subjected to by the tip of the supporting foot of the wearer;

said foot tip control of the accelerator being a pressure transducer of the tip of the foot on the front portion of the upper plate, which, as soon as the back portion is raised with respect to the front portion, directly acts on the speed order of the electronic control system for increasing the required speed proportionally to the measurement of obtained pressure.

11. The personal transportation device according to claim 10, wherein, for each of the two wheeled shoes or undersoles, the motor system comprises at least an inertia motor with kinetic energy, said inertia motor being coupled to the driving supporting means via a high reduction ratio; the system for controlling the motor speed, hence that of the driving wheels, being inherent to the inertia motor, which physically resists to any change of regime due to the inertial counter torque caused during any forced variation of its speed.

12. The personal transportation device according to claim 8, wherein, for each of the two wheeled shoes or undersoles, said personal transportation device comprises:

at least a variable altitude mechanism of the upper plate of the undersole;

at least a rotating torque variator;

said motor system comprising:

at least a mechanical motor operating the gravitational potential energy of the walker himself/herself, by means of said variable altitude mechanism, rendered vertically mobile with respect to the chassis, and mechanically coupled to the driving wheels by racks, cables, chains, belts or gears, and via said rotating torque variator, at least an energy storing device thus being the walker himself/herself, whereof the gravitational potential energy increases when he/she is raised and decreases when he/she is lowered with respect to the ground; controlling the speed of the driving wheels is achieved by the rotating torque variator, whereof the torque variation is controlled by the variable characteristic of the skidding force, namely, the angle $\alpha$, measured by means of a sensor specific to each of the heel and tip phases of the step.

13. The personal transportation device according to claim 4 or claim 12, wherein the rotating torque variator, enabling a torque variation even when the motor is off, is a system with dual inverted and superposed curvilinear cones, whereof the axes remain maintained in the same vertical plan, the torque variation according to the angle $\alpha$ being controlled by coupling the sensor of the angle $\alpha$ to a control of the inclination of the axis of the upper curvilinear cone in this vertical plan, which makes this curvilinear cone roll on the lower curvilinear cone along their respectively lower and higher generatrice; the two cones also able to turn around their respective axis for the torque transmission which is thus function of the ratio of the radiuses of the section disks at their contact point; the friction required for the torque transmission on the contact area of the curvilinear cones being obtained by applying a force of sufficient pressure on the axis of the upper curvilinear cone, this force able to use, wholly or partly, the component perpendicular to the ground of the force applied to the upper plate by the supporting leg, or the pressure springs on the bearings or rolling bearings of the axis of the upper curvilinear cone.

14. The personal transportation device according to claim 6 or claim 12, wherein the coupling between the motor system and the driving wheels comprises a release mechanism with blockage of the energy storing device, altitude of the plate or spring, engaging automatically when the control of the torque variator corresponds to the null value of angle $\alpha$, and automatically reengaging, otherwise, such as to enable a free rolling of the wheeled shoe or undersole based on its acquired speed when it is not subjected to any skidding force.

15. The personal transportation device according to any of claim 3, or 10, wherein said foot tip control enabling the gradual increase, in a few steps, of the global speed of the walker, is the front portion of the upper plate, also laterally articulated in order to constitute a pedal mechanically coupled to the driving supporting means, which increases the speed of the driving supporting means by means of the gravitational potential energy brought by the pressure of the body weight of the walker on tiptoe and its sinking by a distance ranging from 4 mm to 40 mm, depending on the prior acquired initial speed by the wheeled shoe or undersole; as long as the back portion of the upper plate does not rise, this pedal being blocked and its coupling with the driving wheels being released, and, at the end of the lowering and during the rising of the pedal, this coupling also being released, in order to enable free rolling based on the acquired speed.

16. The personal transportation device according to claim 11, wherein the inertia motor comprised a flywheel or a counter-rotating flywheel system.

17. The personal transportation device according to claim 15, wherein the pedal is mechanically coupled to the driving wheels by racks, cables, chains, belts, or gears.

* * * * *